US006848118B2

(12) United States Patent
Barnes et al.

(10) Patent No.: US 6,848,118 B2
(45) Date of Patent: Feb. 1, 2005

(54) PULLOVER JACKET WITH CUSTOMIZED DECORATIVE BAND

(75) Inventors: David Barnes, Fort Collins, CO (US); Stina Shaw, Waban, MA (US); Barry Lipsett, Medford, MA (US)

(73) Assignee: Charles River Apparel, Inc., Medford, MA (US)

( * ) Notice: Subject to any disclaimer, the term of this patent is extended or adjusted under 35 U.S.C. 154(b) by 515 days.

(21) Appl. No.: 10/080,056

(22) Filed: Feb. 21, 2002

(65) Prior Publication Data

US 2002/0078486 A1 Jun. 27, 2002

Related U.S. Application Data

(60) Provisional application No. 60/272,539, filed on Mar. 1, 2001.

(51) Int. Cl.[7] ..... A41D 1/02

(52) U.S. Cl. ..... 2/108; 2/93; 2/84; 2/244

(58) Field of Search ..... 2/84, 85, 88, 90, 2/115, 244, 93–97, 102, 103–108, 118–122, 246, 248; 40/586; D2/739, 823, 825, 828, 830–833, 839, 840, 844, 853, 854; 705/28, 29, 500

(56) References Cited

U.S. PATENT DOCUMENTS

| | | | | | |
|---|---|---|---|---|---|
| D161,540 | S | * | 1/1951 | Russfield | D2/836 |
| 2,542,300 | A | * | 2/1951 | Bagnato | 2/93 |
| 2,556,039 | A | * | 6/1951 | Landert | 2/106 |
| 2,647,261 | A | * | 8/1953 | Rassner | 40/586 |
| 3,370,370 | A | * | 2/1968 | Lippman | 40/586 |
| 3,381,307 | A | * | 5/1968 | Shingler | 2/94 |
| 3,484,974 | A | * | 12/1969 | Culmone | 40/586 |
| 3,911,500 | A | * | 10/1975 | Naumovski | 2/115 |
| 4,277,848 | A | * | 7/1981 | Boehland | 2/115 |
| 4,408,356 | A | * | 10/1983 | Abrams | 2/87 |
| D277,049 | S | * | 1/1985 | Peyser | D2/831 |
| 4,875,237 | A | | 10/1989 | Cohen | |
| 4,944,042 | A | * | 7/1990 | DeWan | 2/94 |
| 4,969,214 | A | | 11/1990 | Cohen | |
| 5,168,580 | A | * | 12/1992 | Foo | 2/115 |
| 5,398,343 | A | * | 3/1995 | Kuracina | 2/115 |
| 5,588,154 | A | * | 12/1996 | Blauer et al. | 2/69 |
| 6,047,404 | A | * | 4/2000 | Blanks, I | 2/69 |
| 6,182,291 | B1 | * | 2/2001 | Garvey | 2/102 |

* cited by examiner

*Primary Examiner*—Amy B. Vanatta
(74) *Attorney, Agent, or Firm*—Kristofer E. Elbing

(57) ABSTRACT

A product and process involve providing customized pullover jackets, units of which are characterized by (1) pullover body construction units of a type having a fabric configuration that facilitates slipping over the head and shoulders; and (2) decorative band construction units of a type having distinguishable color and design for affixation to said pullover body construction. The process comprises acquiring a relatively small inventory of body construction units of different sizes, acquiring a relatively large inventory of band construction units of different colors or designs, and receiving and fulfilling orders for the customized pullover jackets from customers. The body construction units account for the major component of unit cost. The band construction units account for a minor component of unit cost. The customized jackets are assembled by joining mating fasteners on the upper and lower edges of selected band construction and corresponding upper and lower points on selected body constructions. Extending from each body construction is an elongated flap that overlaps the upper edge of the band construction.

26 Claims, 4 Drawing Sheets

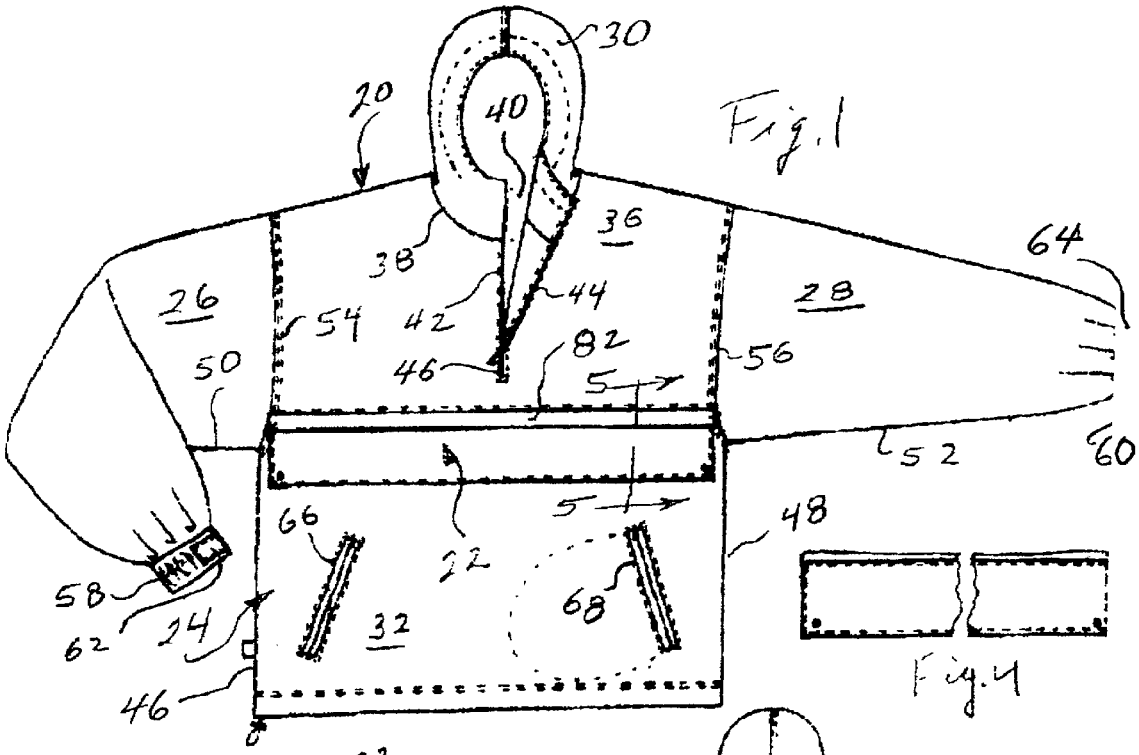
Fig. 1
Fig. 4
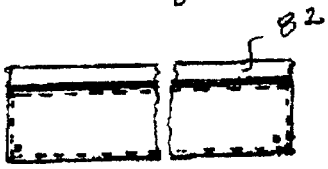
Fig. 3
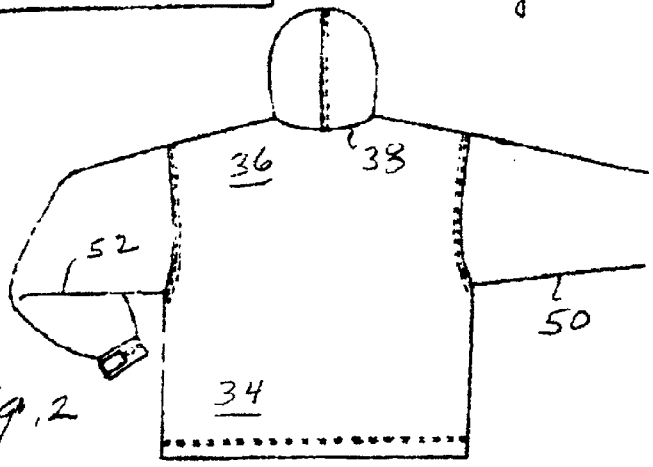
Fig. 2

90
106
86
88
60
64

PULLOVER JACKET WITH CUSTOMIZED DECORATIVE BAND

CROSS-REFERENCES TO RELATED APPLICATIONS

The applicant wishes to claim the benefit of U.S. Provisional Patent Application No. 60/272,539, filed Mar. 1, 2001, for PULLOVER JACKET WITH CUSTOMIZED DECORATIVE BAND, in the names of David Barnes, Stina Shaw, and Barry Lipsett.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to pullover jackets of the type that may be adorned with decorative bands or the like, which are intended to provide a visual flourish that is appropriate for sports activities and events.

2. Description of the Related Art

A pullover jacket typically is characterized by a clothing construction that facilitates its being slipped on and off over the head and shoulders. Such jackets often are provided with decorative bands or the like, which are chosen by individuals or organizations as a matter of personal preference or as an emblem of group identity. In view of the many different colors and designs that often are ordered for immediate delivery, sales organizations that carry such pullover jackets have had to maintain unduly large and costly inventories in order to accommodate a diversity of customers.

BRIEF SUMMARY OF THE INVENTION

The primary object of the present invention is to provide, for convenient assembly as a customized pullover jacket unit: (1) a body construction having a configuration that is designed to be slipped over the head and shoulders; and (2) one or more decorative band constructions having distinguishable color and design for ready affixation to the pullover jacket construction. To enable such assembly, each body construction, which accounts for the major component of unit cost, is completely fabricated except for the decorative band or bands. Available for attachment to the body construction are any of a great variety of band constructions of different colors and designs, each of which individually accounts for a minor component of unit cost. As a practical matter, such an inventory includes a relatively small number of body constructions in a range of sizes, and a relatively large number of band constructions in a variety of colors and designs. By virtue of the foregoing assembly system, keeping an economical inventory is feasible.

It is desired that the assembly of each body construction and band construction appears to be a unitary original manufacture. Because of the acute sensitivity of the human eye to even a minor misalignment or discontinuity, the present invention provides the following interconnections pursuant to the present invention. At the upper and lower edges of the band construction and at corresponding upper and lower points on the body construction are mating fasteners. Extending from the body construction is an elongated flap that overlaps the upper edge of the band construction. Since, ordinarily, the human eye looks downwardly at the band construction, the flap masks the fasteners and any visual discontinuity at its upper edge. Also, since, ordinarily, the human eye looks downwardly at the band construction, the fasteners and the shadows, which might constitute a visual discontinuity at the band's lower edge, are not casually noticeable. Furthermore, since the mating fasteners are precisely located on the band and body constructions, misalignment is precluded during assembly. Preferably, the mating fasteners at the upper edge of the band construction are constituted by the mating articulations of a zipper, which extends continuously throughout the upper edge of the band construction for the purpose of preventing noticeable wrinkles.

BRIEF DESCRIPTION OF THE DRAWINGS

For a fuller understanding of the nature and object of the present invention, reference is made to the accompanying drawings, wherein:

FIG. 1 is a front view of a pullover jacket embodying the present invention;

FIG. 2 is a back view of the jacket of FIG. 1;

FIG. 3 is a broken-away and enlarged front view of the decorative band of the jacket of FIG. 1;

FIG. 4 is a broken-away and enlarged back view of the decorative band of the jacket of FIG. 1;

DETAILED DESCRIPTION OF THE INVENTION

Figure 5:
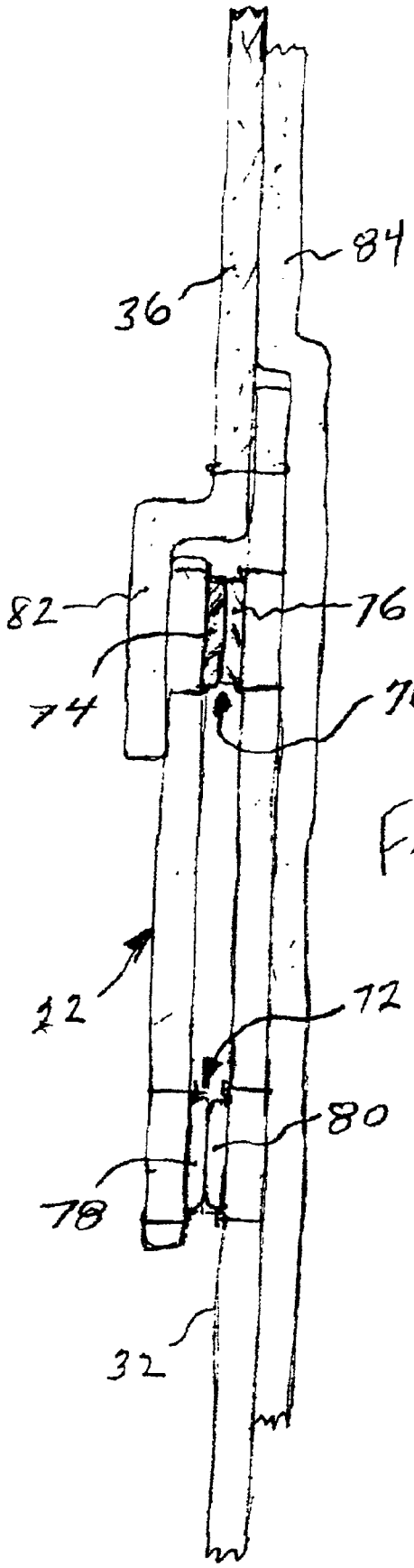
FIG. 5 is a cross-sectional view of the construction of the jacket of FIG. 1, taken along the line 5—5 of FIG. 1.

The Embodiment of FIGS. 1 through 5

FIGS. 1 through 5 illustrate a preferred embodiment of the present invention as a body construction 20 and a band construction 22. The body construction comprises a bodice 24, a pair of sleeves 26 and 28, and a hood 30. The band construction blends with the body construction to provide a smoothly integrated appearance.

Bodice 24 includes a front lower body section 32, a back lower body section 34, and a yoke section 36. Yoke section 36 extends over the shoulders from the front lower body section to the back lower body section. In the embodiment of FIGS. 1 through 5, yoke section 36 and back lower body section 34 are integral and continuous. Hood 30 projects through an opening 38 in yoke section 36 and, together with the front of the yoke section, provide a slit 40. The opposed edges 42 and 44 of the slit are provided with the mated articulations of a zipper 46. Seams along lines 46 and 48 join the side edges of the front and back lower body sections.

The sleeves are formed by loops having longitudinal seams 50 and 52, which extend from the armpits to the wrists. The inner extremities of the sleeves are joined to yoke section 36 and to lower front and lower back sections 32 and 34 by stitching 54 and 56. The outer extremities of the sleeves have cuffs 58 and 60, which can be constricted tightly about the wrists by hook and loop, i.e. Velcro, straps 62 and 64. Front lower body section 32 has oblique pockets 66 and 68, which are provided with zippered closures.

As shown in FIGS. 1 and 5, band construction 22 is affixed to front lower body section 32 by a zipper shown at 70 at the upper edges of the band, and a pair of snaps at the lower corners of the band, one such snap being shown at 72. Zipper 70 has mated lengths of articulations 74 and 76, which extend along the entire upper edge of the front band construction. Snaps have male and female detents 78 and 80 at the lower corners of band construction 22. The lower periphery of the front section of yoke 36 provides a flap 82, which conceals the upper edge of band construction 22 and the zipper extending there along. In an alternative embodiment, the zipper is replaced by a distribution of snaps.

As shown in FIG. 5, jacket construction 20 includes a 3 shell and a lining. The shell includes the outer strata of the aforementioned yoke, sleeves, body sections and hood. The lining, which backs the shell and is fastened to it by stitching at peripheral locations, is shown at 84. In various forms, the shell preferably is composed of one of the following: a taffeta-type fabric such as 210T taffeta nylon; a high spun nylon taslon-like or Tactel fabric; and a brushed fleece knit. Preferably, the lining is composed of a flannel-type fabric, which is characterized by a napped, soft surface.

Figure 6:
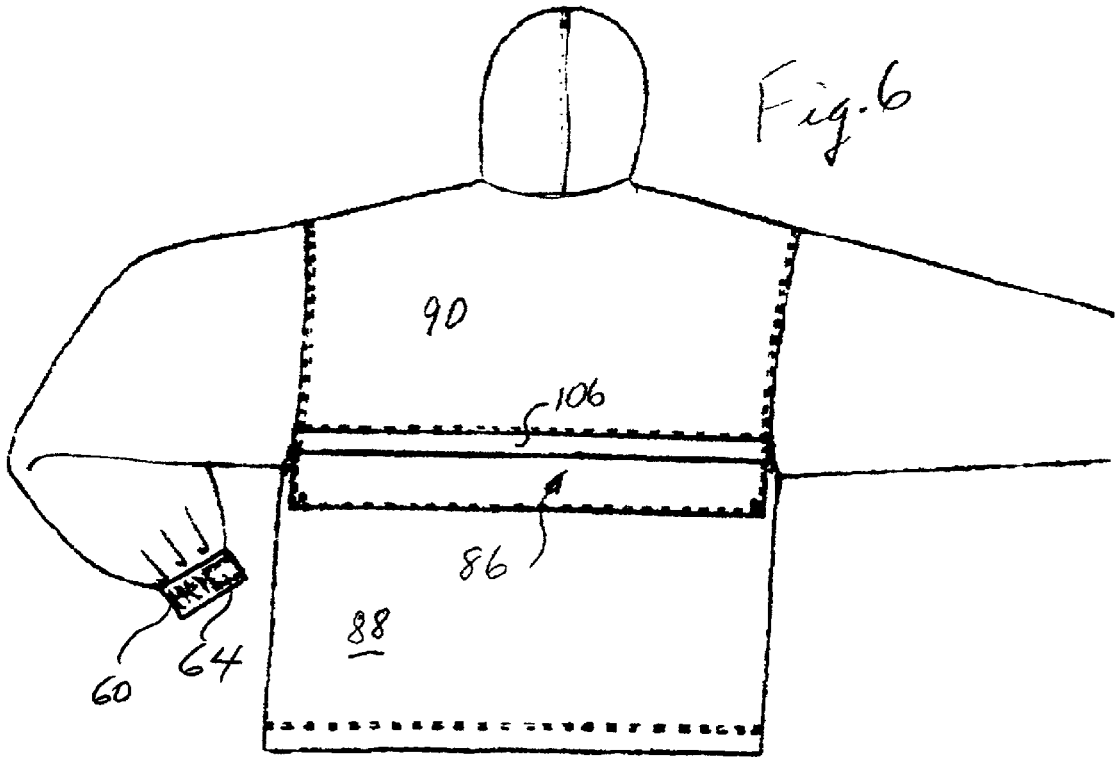
FIG. 6 is a back view of a modification of the jacket of FIG. 1.

The Embodiment of FIG. 6

FIG. 6 illustrates the back of another jacket embodying the present invention. This jacket, shown at 86, comprises all of the features of the jacket of FIGS. 1 through 5, except for the structure at its back. Thus the front of the jacket of FIG. 6 is identical to the front of jacket of FIGS. 1 through 5. However, in the jacket of FIG. 6, the back comprises a band construction 86 and a lower back body construction 88. Here, the yoke, shown at 90 extends over the shoulders from the front lower body section to the back lower body section.

In the manner of FIG. 5, band construction 86 is affixed to back lower body section 92 by a zipper shown at 94 at the upper edges of the band, and a pair of snaps at the lower corners of the band, one such snap being shown at 96. Zipper 94 has mated lengths of articulations 98 and 100, which extend along the entire upper edge of the back band construction. Snaps have male and female detents 102 and 104 at the lower corners of band construction 86. The lower periphery of the back section of yoke 90 provides a flap 106, which conceals the upper edge of band construction 86 and the zipper extending there along. In an alternative embodiment, the zipper is replaced by a distribution of snaps.

Figure 7:
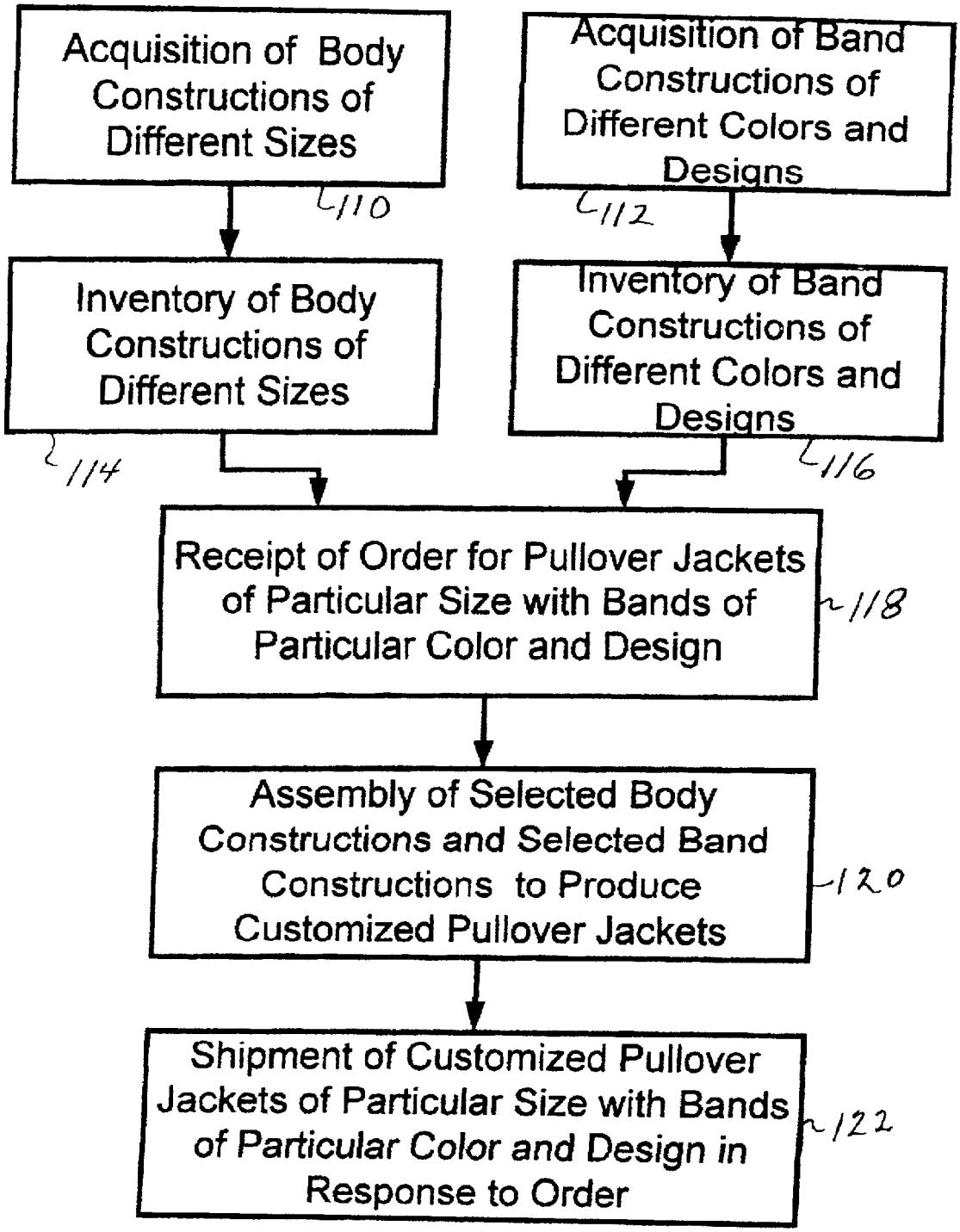
FIG. 7 is a block diagram of the system and process of the present invention.

The System and Process of FIG. 7

The present invention contemplates the acquisition by a distributor or retailer, as at 110 and 112, inventories 114 of jacket constructions of different sizes and inventories 116 of bands of matching sizes. For example, the jacket constructions cover the following selections of sizes: Small/Medium, Large/X-Large, and XX-Large/XXX-Large. The selections of the lengths, i.e. the horizontal dimensions, of the bands are commensurate with the selections of these jacket construction sizes. Preferably, the bands range in height, i.e. in vertical dimension, from 2 to 6 inches. Thus, the zippers and flaps at the upper edges of bands for larger sizes are longer than the zippers and flaps at the upper edges of the bands for smaller sizes. Also, the snaps at the horizontal corners of the bands for larger sizes are farther apart than the snaps at the horizontal corners of the bands for smaller sizes. When an order is received as at 118, the seller assembles the customized pullover jacket unit or units as at 120, and ships or otherwise delivers them, as at 122, to the customer.

OPERATION

Each customized unit comprises (1) a pullover jacket construction having a fabric configuration that facilitates slipping over the head and shoulders; and (2) a band construction having distinguishable color and design for affixation to the pullover jacket construction. The inventory of jacket constructions, which accounts for the major component of unit cost, is completely fabricated except for the decorative band or bands. Available for attachment to the pullover jacket construction are any of a great variety of bands of different colors and designs, each of which individually accounts for a minor component of unit cost. By virtue of the foregoing assembly arrangement, an economical inventory arrangement is feasible. Such an inventory includes a relatively small number of pullover body constructions in a range of sizes, and a relatively large number of band construct ons in a variety of colors and designs. At the upper and lower edges of the band construction and at corresponding upper and lower points on the jacket construction are mating detents. Extending from the jacket construction is an elongated flap that overlaps the upper edge of the band construction. Since, ordinarily, the human eye looks downwardly at the band construction, the flap masks the fasteners and any visual discontinuity at its upper edge. Also, since, ordinarily, the human eye looks downwardly at the band construction, the fasteners and the shadows, which constitute the visual discontinuity at its lower edge, are not casually noticeable. Furthermore, since the mating fasteners are precisely located on the band and jacket constructions, misalignment is precluded during assembly. Preferably, the mating fasteners at the upper edge of the band construction are constituted by the mating articulations of a zipper, which extends continuously throughout the upper edge of the band construction for the, purpose of preventing noticeable wrinkles.

We claim:

1. A pullover jacket comprising:

(a) a pullover body construction having a bodice with a yoke section attached to a first lower body section and a second lower body section, said yoke section extending from said first lower body section over the shoulders and to said second lower body section, said first lower body section having a first lower body section upper edge;

(b) a band construction extending across said first lower body section upper edge, said band construction having an upper edge and a lower edge;

(c) mating interconnections between said body construction and said band construction, said mating interconnections having mating interconnections along selected positions along said upper edge of said band construction and along upper corresponding positions on said first lower body section upper edge;

mating interconnections along selected positions on said lower edge of said band construction and along lower corresponding positions on said first lower body section; and (d) a flap extending outwardly from said bodice and across said bodice along a lower periphery of said yoke section, said flap concealing said upper edge of said band construction and said mating interconnections at said upper edge of said band construction;

whereby said band construction and said body construction provide said pullover jacket with a smoothly integrated appearance.

2. The pullover jacket of claim 1 wherein said mating interconnections along said upper edge of said band construction and said upper corresponding positions on said first lower body section upper edge constitute a zipper.

3. The pullover jacket of claim 1 wherein sold mating interconnections along said lower edge of said band construction and said lower corresponding positions on said first lower body section comprise snaps.

4. The pullover jacket of claim 1 wherein said mating interconnections comprise a distribution of snaps.

5. The pullover jacket of claim 1 wherein said band construction comprises a first hand construction and wherein said yoke section is attached to said second lower body section, said second lower body section having a second lower body section upper edge, said pullover jacket further comprising:

a second band construction extending across said second lower body section upper edge, said second band construction having a second band upper edge and a second band lower edge;

second mating interconnections between said body construction and said second band construction said second mating interconnections having second upper mating interconnections along selected positions along said second band upper edge and along second band upper corresponding positions on said second lower body section upper edge, and second lower mating interconnections along selected positions on said second band lower edge and along second band lower corresponding positions on said second lower body section; and a second flap extending outwardly from said bodice and across said bodice along a second lower periphery of said yoke section, said second flap concealing said second band upper edge and said second bad upper mating interconnections wherein said first band construction and said second band construction are horizontally aligned opposite each other in a horizontal stripe across sold pullover jacket.

6. The pullover jacket of claim 1 wherein said band construction is sized to match said body construction, and said body construction is one of an inventory of body construction sizes, and said band construction is one of an inventory of band construction sizes that match said body construction sizes.

7. The pullover jacket of claim 1 wherein section of a length of said band construction is commensurate with selection of a body construction size.

8. The pullover jacket of claim 1 wherein said band construction ranges in height from 2 to 6 inches.

9. The pullover jacket of claim 1 wherein said first lower body section comprises a front lower body section, and wherein said second lower body section comprises a back lower body section.

10. The pullover jacket of claim 1 wherein said first lower body section comprises a back lower body section, and wherein said second lower body section comprises a front lower body section.

11. An inventory of components for a pullover jacket comprising an inventory of body constructions and an inventory of band constructions:

(a) said body constructions being of a body type having a bodice comprising a yoke section attached to a first lower body section and extending from said first lower body section over the shoulders and to a second lower body section, said first lower body section having a first lower body section upper edge;

(b) said band constructions being of a band type extending across said bodice and having a band upper edge and a band lower edge;

(c) mating interconnections between said bodice and said band constructions, said mating interconnections having mating interconnections along selected positions along said band upper edge and along upper corresponding positions on said first lower body section upper edge, and mating interconnections along selected positions on said band lower edge and along lower corresponding positions on said first lower body section; and (d) a flap extending outwardly from said bodice and across said bodice along a lower periphery of said yoke section, said flap concealing said band upper edge and said mating interconnections at said band upper edge;

whereby said band constructions and said body constructions provide said pullover jacket with a smoothly integrated appearance.

12. The inventory of claim 11 wherein said mating interconnections along said band upper edge and said upper corresponding positions on said first lower body section constitute a zipper.

13. The inventory of claim 11 wherein said mating interconnections along said band lower edge and said lower corresponding positions on said first lower body section include snaps.

14. The inventory of claim 11 wherein said mating interconnections include a distribution of snaps.

15. The inventory of claim 11 wherein said band construction comprises a fist band construction and wherein said yoke section is attached to said second lower body section, said pullover jacket further comprising a second band construction extending across said second lower body section, said second band construction having a second band upper edge and a second band lower edge;

second mating interconnections between said body construction and said second band construction, said second mating interconnections having second upper mating interconnections along selected positions along said second band upper edge and along second band upper corresponding positions on said second lower body section, and second lower mating interconnections along selected positions on said second band lower edge and along second band lower corresponding positions on said second lower body section; and a second flap extending outwardly from said bodice and across said bodice along a second lower periphery of said yoke section, said second flap concealing said second band upper edge and said second band upper mating interconnections;

wherein said first band construction and said second band construction are horizontally aligned opposite each other in a horizontal stripe across said pullover jacket.

16. The inventory of claim 11 wherein said band constructions are sized to match said body constructions, and each of said body constructions is selected from one of an inventory of body constructions sizes, and each of said band constructions is selected from one of an inventory of band constructions sizes that match said body construction sizes.

17. The inventory of claim 11 wherein selection of length of each of said band constructions is commensurate with selection of a body construction size.

18. The inventory of claim 11 wherein each of said band constructions ranges in height from 2 to 6 inches.

19. The inventory of claim 11 wherein said mating interconnections along sold band upper edge and said upper corresponding positions on said body construction include a distribution of snaps.

20. The inventory of claim 11 wherein said first lower body section comprises a front lower body section, and wherein said second lower body section comprises a back lower body section.

21. The inventory of claim 11 wherein said first lower body section comprises a back lower body section, and wherein said second lower body section comprises a front lower body section.

22. An inventory process of providing customized pullover jackets, units of which are characterized by (1) pullover body construction units of a type having a fabric configuration that facilitates slipping over the head and shoulders; and (2) band construction units for affixation to said pullover body construction, said process comprising the steps of:

(a) acquiring an inventory of said pullover body construction units, said pullover body construction units being of different sizes, each of said body construction units including a bodice comprising a yoke section attached to a first lower body section and extending from said first lower body section over said shoulders and to a second lower body section, said first lower body ection having a first lower body section upper edge;

each of said body construction units having a flap extending outwardly from said bodice and across said bodice along a lower periphery of said yoke section;

(b) acquiring an inventory of said band construction units, each of said band construction units having a band upper edge and a band lower edge;

said band upper edge and said band lower edge and corresponding upper and lower points on said body construction units having mating fasteners; and (c) receiving orders for said customized pullover jackets from customers, said body construction units accounting for a major component of unit cost of said providing customized pullover jackets, and said band construction units accounting for a minor component of said unit cost (d) assembling selected band construction units and selected body construction units by joining said mating fastener to provide said customized pullover jackets, said mating fastener being precisely located on said band construction units and said body construction units to preclude misalignment during said assembly, and said flap masking said fasteners and any visual discontinuity at said upper edge.

23. The inventory process of claim 22 wherein said mating fasteners at said bend upper edge comprise a zipper that extends continuously along said upper edge.

24. The inventory process of claim 22 wherein said mating fasteners at said band upper edge comprise distributed snaps that extend along said upper edge.

25. The inventory process of claim 22 wherein said first lower body section comprises a front lower body section, and wherein said second lower body section comprises a back lower body section.

26. The inventory process of claim 22 wherein said first lower body section comprises a back lower body section, and wherein said second lower body section comprises a front lower body section.

* * * * *